US005197578A

United States Patent [19]

Van Hooreweder

[11] Patent Number: 5,197,578

[45] Date of Patent: Mar. 30, 1993

[54] LUGGAGE WITH FOUR ROLLING ELEMENTS

[75] Inventor: Godwin Van Hooreweder, Brugge, Belgium

[73] Assignee: Samsonite Corporation, Denver, Colo.

[21] Appl. No.: 830,085

[22] Filed: Feb. 3, 1992

[30] Foreign Application Priority Data

Feb. 4, 1991 [FR] France ..... 91 01230

[51] Int. Cl.[5] ..... A45C 13/00

[52] U.S. Cl. ..... 190/18 A; 190/115

[58] Field of Search ..... 190/18 A, 115; 280/47.34

[56] References Cited

U.S. PATENT DOCUMENTS

| | | | |
|---|---|---|---|
| 2,132,316 | 10/1938 | Newton | 190/18 A |
| 3,655,215 | 4/1972 | Becklin | 190/18 A |
| 3,861,703 | 1/1975 | Gould | 190/18 A |
| 3,987,875 | 10/1976 | Szabo | 190/18 A |
| 4,385,415 | 5/1983 | Volz | 190/18 A |
| 4,733,759 | 3/1988 | Shih-Chen | 190/18 A |

*Primary Examiner*—Gary E. Elkins

*Attorney, Agent, or Firm*—Gregory W. O'Connor

[57] ABSTRACT

The invention relates to luggage equipped with four rolling elements. Three of the elements (34, 36, 38) swivel on axles which are mounted more or less perpendicular to the face (28) of the luggage to which they are attached, while the fourth element (40) has a fixed rotation axis. According to this embodiment, the luggage may be moved either by pushing it while it rests on all four rolling elements or by pulling it, in which case it rests on the two swiveling rolling elements (34, 36) located along the longer side of the luggage face (28) to which they are attached.

3 Claims, 2 Drawing Sheets

LUGGAGE WITH FOUR ROLLING ELEMENTS

This invention relates to luggage and, more particularly, to luggage equipped with rolling elements.

There are many known embodiments of luggage equipped with rolling elements comprised, in particular, of several elements, such as casters, located on one lateral face of the luggage. When the luggage is of a general parallelepiped shape, it has a bottom, a lid, and four lateral faces, and the four lateral faces consist of two longer sides opposite one another and two shorter sides opposite one another. The rolling elements may be positioned either on one of the longer sides or on one of the shorter sides, with a prehension (pulling) device positioned on the side opposite the face to which the rolling elements are attached.

When there are four rolling elements, a known embodiment is to have two elements turn on fixed rotation axes, and the other two elements swivel on axles which are perpendicular to the face of the suitcase to which they are attached. When the user rolls the suitcase, the two swiveling casters are positioned in front and the two fixed casters are positioned in back. In this way, the luggage may be easily guided while at the same time maintaining a relatively stable path of movement.

However, such an embodiment has certain disadvantages, in particular when the casters are attached to one of the shorter lateral luggage faces and the said luggage is moved across an uneven surface (such as carpeting), up and down steps or stairways, or in the uphill direction of an inclined surface. Under these circumstances, it is difficult to move the luggage by pushing it and it may become stuck. It would be desirable at these times to be able to move the luggage by pulling it, but the known embodiment comprising the two fixed casters in the back and the two swiveling casters in the front, with the handle positioned in the middle of the opposite luggage face, does not make it possible to move the luggage in this way.

Further, even when a handle or an additional pulling device is provided on one of the lateral faces adjacent to the face to which the casters are attached, there is little space between the casters, and for this reason the luggage is not stable when it rests on only two of the rolling elements.

Document FR-A-2 426 426 presents another luggage embodiment providing four rolling elements with fixed axles which are arranged in perpendicular pairs and all attached to the same lateral face of the luggage. Such an embodiment makes it possible to move the luggage in two different positions, but neither of these two positions allows the luggage to rest on all four of the rolling elements because, when it rests on all four elements, one pair of elements is oriented in such a way as to be perpendicular to the direction of movement and thus rolls in the opposite direction of the other pair.

The object of the present invention is to provide luggage equipped with four rolling elements positioned on the same luggage face, the said luggage being capable of being moved as conditions dictate, either by pushing or pulling.

Accordingly, the object of the invention is a luggage comprising four rolling elements attached to one face of the luggage and turning on axles which are more or less parallel to the said luggage face, and at least one prehension device positioned more or less opposite to the said luggage face, the said luggage being characterized by the fact that three of the four rolling elements swivel on axles which are more or less perpendicular to the said luggage face, and the fourth turns in a fixed rotation axis.

Reference should be made to the following detailed description in connection with the accompanying drawings, provided only as a non-limiting example, in which.

Figure 1:
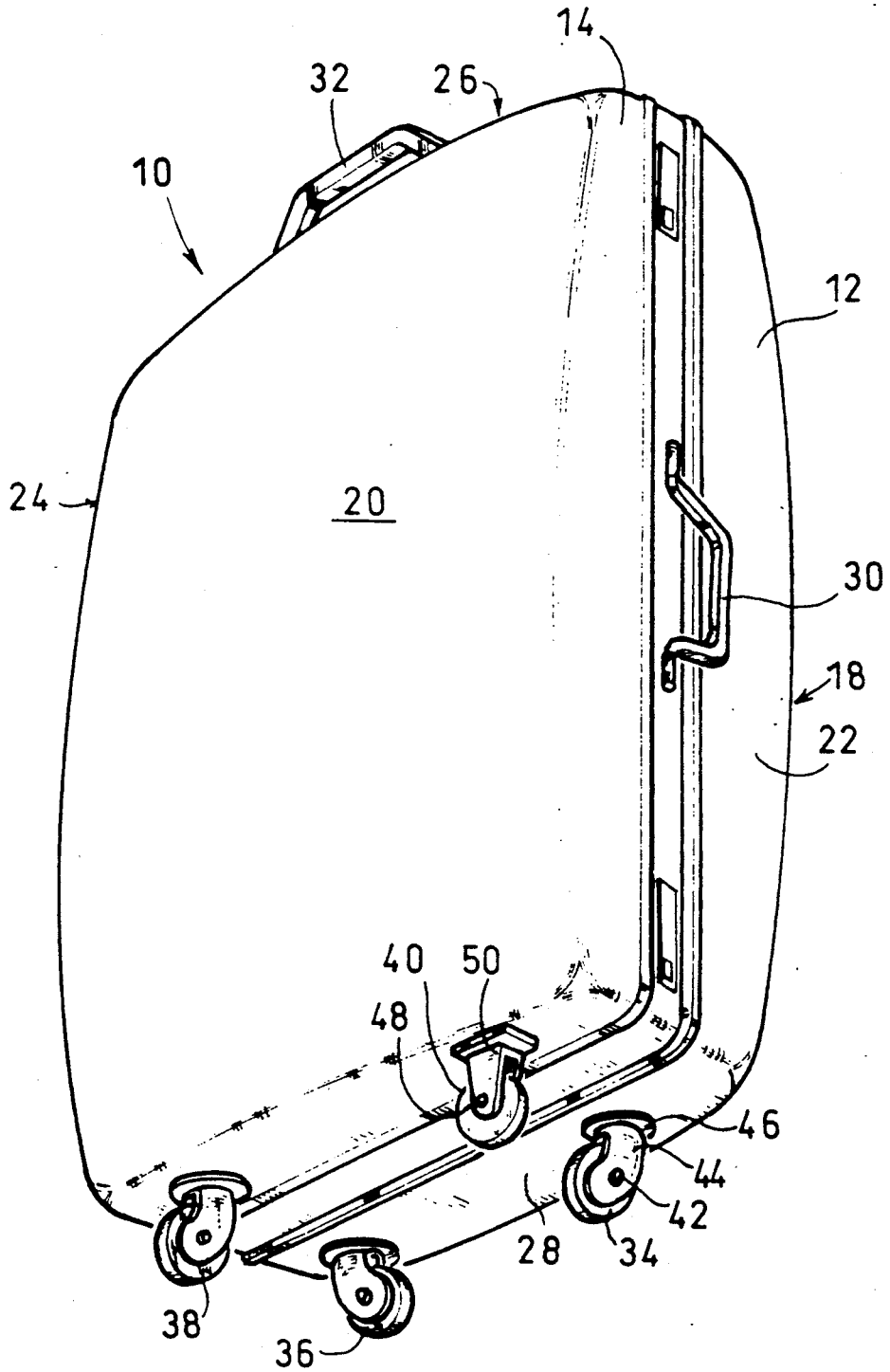
FIG. 1 is a perspective drawing showing a suitcase equipped with rolling elements according to the invention.

The drawings show luggage 10 consisting, in the example chosen, of a rigid suitcase divided into two equal halves 12, 14, attached to one another by a hinge (not shown on the drawing) positioned on one of the longer luggage sides.

The two halves consist of two large faces, one of which constitutes the bottom 18 of the suitcase and the other the lid 20, and four lateral faces consisting of two longer lateral faces opposite one another 22, 24, and two shorter lateral faces opposite one another 26, 28.

In the example shown, the suitcase has two handles 30, 32, wherein one 30 is located on the longer lateral face opposite the face to which the hinge is attached, and the other 32 is located on the shorter lateral face 26 opposite the face 28 to which the four rolling elements 34, 36, 38, 40 are attached. The four rolling elements are positioned near the four corners of luggage face 28 and are composed of casters whose rotation axes are more or less parallel to luggage face 28.

According to the invention, three of these casters 34, 36, 38 swivel on axles which are more or less perpendicular to the face of the luggage to which they are attached; the fourth, however, has a fixed rotation axis. These different casters are of known construction: each swivel caster turns on an axle 42 which is parallel to luggage face 28, said axle being mounted in turn in a yoke 44 which turns on a metal brace 46 attached to the corresponding half of the suitcase. According to a known feature, the rotation axis of the caster is offset, or off-center, in relation to the turning axis of the yoke.

The fourth caster 40 rotates on an axle 48 mounted in a yoke 50 which is attached in a stationary fashion to the corresponding half of the suitcase. The axle 48 is positioned so that it is parallel to the shorter sides of luggage face 28.

Figure 2:
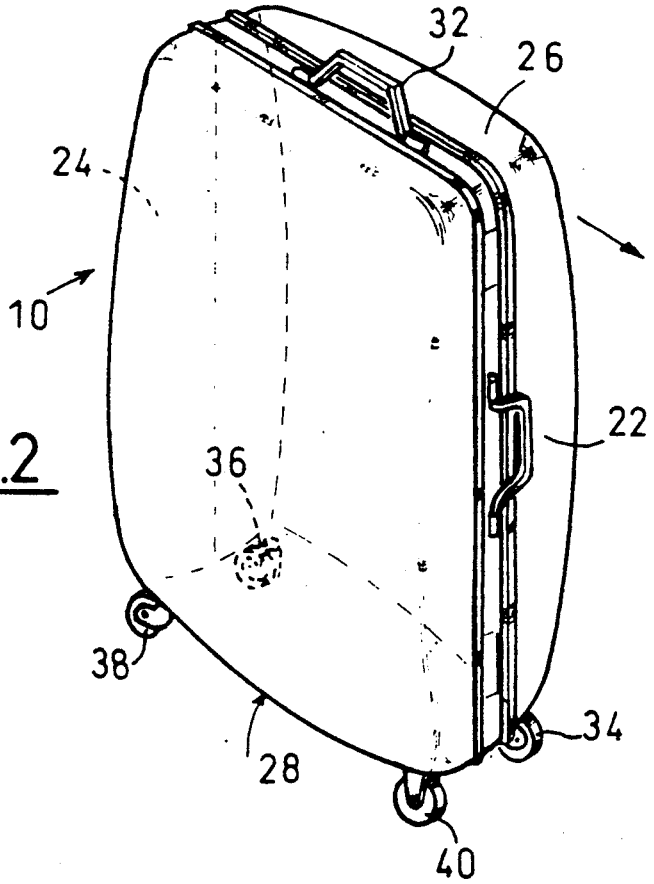
FIGS. 2 and 3 are diagrams illustrating the two methods for moving this suitcase.
Figure 3:
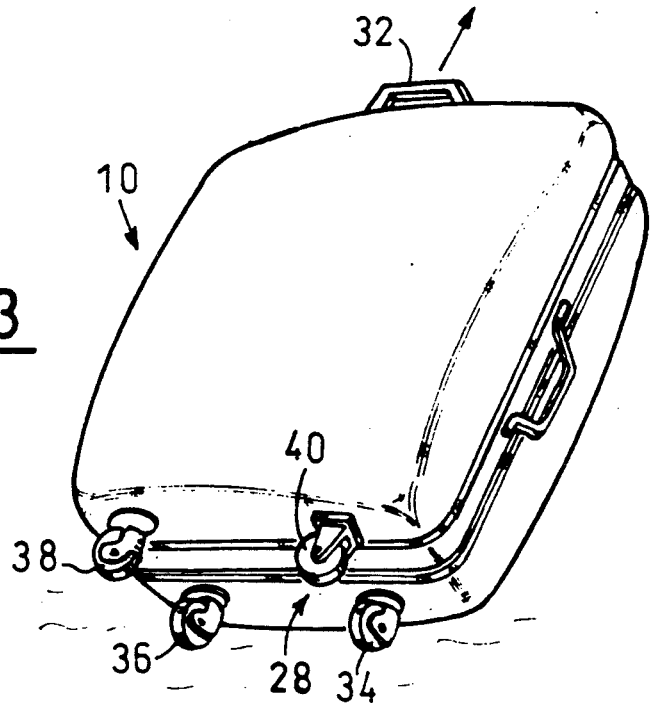

The method for using such luggage is shown in the diagrams in FIGS. 2 and 3:

In the example shown in FIG. 2, the suitcase is vertical and rests on all four casters. When it is in this position, the user moves it by pushing it or by holding it at his or her side using the handle 32. The suitcase is very stable because it rests on all four casters. It is easy to move in any direction because the two front casters swivel and can therefore be easily re-oriented. It also has a stable movement path due to the positioning of the fixed caster 40 in the back.

When the luggage must be moved across an uneven surface or uphill, the user may position it as shown in FIG. 3, in which the suitcase rests on the two re-orientable swivel casters 34, 36 located on the longer side of luggage face 28. The swivel casters are easily placed in the desired position because of their off-center mounting. In this way, the user may move the luggage by pulling it, by the handle 32.

It will thus be seen from the preceding that the problem set forth at the beginning of this memorandum is solved in a particularly effective, simple, and inexpensive way, with a considerable advantage to the user.

It is to be understood that although the invention as presented applies to a rigid suitcase comprised of two equal halves, it applies as well to all other types of luggage, of both flexible and rigid construction, as well as to "bag" type luggage, which may be fitted with four rolling elements on the bottom as provided according to the invention.

Further, these rolling elements may be positioned on one of the shorter lateral faces of a suitcase, as shown, or on one of the longer lateral faces; the embodiment in which the rolling elements are placed on the shorter lateral face is preferred because the luggage is less bulky in width when it is moved as shown in FIG. 2, thus facilitating handling.

It is also clear that the prehension devices used in moving the luggage may be either handles located at any suitable point on the luggage face opposite the face to which the rolling elements are attached, or offset handles or straps located toward the adjacent main luggage face. These prehension devices may be be extendible or retractable.

When the luggage is of the embodiment which includes a bottom and a lid, the fixed axis rolling element is preferably attached to the lid.

I claim:

1. A luggage case having a handle attached thereto adjacent to an upper end of the luggage case and at least one bottom face which is generally parallel to a surface supporting the luggage case when the case is upright, at least four rolling elements, each equipped with an axle, the four rolling elements being positioned such that the axles are substantially parallel to said bottom face, the improvement comprising three of said four rolling elements have mounting means for permitting the rolling elements to swivel around axes generally perpendicular to the bottom face and to each said axle, and wherein the fourth rolling element is attached to the luggage case by attachment means for holding its axle in a fixed relationship to said bottom face, whereby said three of the four rolling elements are capable of swiveling about said perpendicular axes and said fourth element is fixed relative to said bottom face.

2. A luggage case according to claim 1 wherein said luggage case has an overall parallelopiped shape and comprises a lid shell and a base shell, means for closing the lid and base shells to form a closed volume in said parallelopiped shape, each of said shell having two long lateral faces and two short lateral faces, said luggage face comprising two adjacent lateral faces of said two shells.

3. A luggage case as set forth in claim 1 wherein each of said four rolling elements are located near a corner of said luggage face.

* * * * *